US011549258B2

(12) United States Patent
Shields

(10) Patent No.: US 11,549,258 B2
(45) Date of Patent: Jan. 10, 2023

(54) RADIATION SHIELDING STRUCTURE

(71) Applicant: Daniel John Shields, Dewitt, MI (US)

(72) Inventor: Daniel John Shields, Dewitt, MI (US)

( * ) Notice: Subject to any disclaimer, the term of this patent is extended or adjusted under 35 U.S.C. 154(b) by 701 days.

(21) Appl. No.: 16/535,522

(22) Filed: Aug. 8, 2019

(65) Prior Publication Data

US 2021/0040728 A1 Feb. 11, 2021

(51) Int. Cl.

| | |
|---|---|
| ***E04B 1/92*** | (2006.01) |
| ***G21F 7/005*** | (2006.01) |
| ***E04B 1/08*** | (2006.01) |
| ***E04B 1/19*** | (2006.01) |
| *E04H 3/08* | (2006.01) |

(52) U.S. Cl.

CPC ..... *E04B 1/92* (2013.01); *E04B 1/08* (2013.01); *E04B 1/19* (2013.01); *G21F 7/005* (2013.01); *E04B 2001/925* (2013.01); *E04H 3/08* (2013.01)

(58) Field of Classification Search

None

See application file for complete search history.

(56) References Cited

U.S. PATENT DOCUMENTS 2,773,459 A * 12/1956 Sechypauls ..... E04H 9/10 976/DIG. 335
2,853,624 A * 9/1958 Wigner ..... G21F 3/00 976/DIG. 335
3,754,675 A * 8/1973 Richard ..... F17C 3/022 220/901
3,780,309 A * 12/1973 Bochard ..... G21F 5/005 250/507.1
4,011,132 A * 3/1977 Kumpf ..... G21C 13/08 376/285
4,074,141 A * 2/1978 Bryant ..... G21F 3/00 976/DIG. 335
4,175,005 A * 11/1979 Harstead ..... G21C 13/08 376/293
4,290,246 A * 9/1981 Hilsey ..... E04H 3/00 D25/19
4,823,523 A * 4/1989 Coupard ..... E04B 1/24 52/33
4,833,335 A * 5/1989 McGinley ..... G21F 7/005 250/517.1
4,959,504 A * 9/1990 Yarger ..... H05K 9/0001 174/386
5,015,863 A * 5/1991 Takeshima ..... G21F 5/10 250/506.1
5,695,443 A * 12/1997 Brent ..... G21F 3/04 405/129.55

(Continued)

*Primary Examiner* — Joshua K Ihezie

(74) *Attorney, Agent, or Firm* — Dunlap Bennett & Ludwig, PLLC

(57) ABSTRACT

A radiation shielding structure or vault includes an outer wall and an inner wall. The outer wall includes at least one outer wall panel formed into a cylinder shape having an outer wall opening. The inner wall includes at least one inner wall panel formed into a cylinder shape having an inner wall opening aligned with the outer wall opening. Tie rods secure the inner wall to the outer wall to support and hold the spacing between the walls. A tunnel structure is inside the inner wall opening and the outer wall opening. A radiation shielding door is coupled to the tunnel structure. A radiation shielding filler material is disposed in between the outer wall and the inner wall.

8 Claims, 4 Drawing Sheets

(56) References Cited

U.S. PATENT DOCUMENTS

| | | | | |
|---|---|---|---|---|
| 6,626,264 | B1 * | 9/2003 | Christen | H05K 9/0001 181/290 |
| 6,973,758 | B2 * | 12/2005 | Zeik | E04H 1/125 52/561 |
| 8,800,808 | B2 * | 8/2014 | Dingeldein | B65D 90/043 220/650 |
| 10,034,418 | B1 * | 7/2018 | Tuan | C04B 28/02 |
| 10,878,974 | B2 * | 12/2020 | Ford | G21F 3/00 |
| 2003/0101670 | A1 * | 6/2003 | Gustin | E04G 17/12 249/34 |
| 2012/0007004 | A1 * | 1/2012 | Valentin | G21F 5/10 250/506.1 |
| 2013/0042538 | A1 * | 2/2013 | Lekhtman | E04D 13/0481 52/84 |
| 2013/0207413 | A1 * | 8/2013 | Lookebill | B29D 99/0021 428/483 |
| 2015/0101275 | A1 * | 4/2015 | Lefkus, III | E04H 3/08 52/741.1 |
| 2015/0292201 | A1 * | 10/2015 | Simson | G21F 3/00 52/27 |
| 2017/0365365 | A1 * | 12/2017 | White | H05K 9/00 |
| 2018/0179778 | A1 * | 6/2018 | Tollefson | E04H 13/006 |
| 2019/0103197 | A1 * | 4/2019 | Singh | G21F 5/10 |
| 2019/0185260 | A1 * | 6/2019 | Lanigan | B65D 88/08 |
| 2019/0326028 | A1 * | 10/2019 | Singh | G21C 19/06 |

* cited by examiner

RADIATION SHIELDING STRUCTURE

BACKGROUND OF THE INVENTION

The present invention relates to radiation shielding and, more particularly, to a radiation shielding structure (vault).

Ionizing radiation is widely used in the medical and industrial industry along with many other applications. These uses can present a significant health hazard by causing microscopic damage to living tissue. The fundamentals to radiation protection are the avoidance or reduction of dose (exposer) using the simple protective measures of time, distance and shielding. The duration of exposure should be limited to that necessary, the distance from the source of radiation should be maximized, and the source shielded wherever possible.

Radiation shielding vaults are needed as permanent and temporary vaults depending on the application needed. All industries use both permanent and temporary vaults. Simple low-cost radiation shielding vaults are also needed for medical equipment in locations, such as 3$^{rd}$ world countries. Current radiation shielding vaults are expensive. Additionally, building current radiation shielding values is very time consuming, require highly skilled labor, require lots of materials, a lot of preparation time, and are generally not reusable.

As can be seen, there is a need for an improved permanent and temporary radiation shielding vaults

SUMMARY OF THE INVENTION

In one aspect of the present invention, a radiation shielding vault comprises: an outer wall comprising at least one outer wall panel formed into a cylinder shape and comprising an outer wall opening; an inner wall comprising at least one inner wall panel formed into a cylinder shape and comprising an inner wall opening aligned with the outer wall opening; a tunnel structure is inside the inner wall opening and the outer wall opening; a radiation shielding door coupled to the tunnel structure; a radiation shielding filler material disposed in between the outer wall and the inner wall; and a roof covering open top ends of the inner wall and the outer wall.

These and other features, aspects and advantages of the present invention will become better understood with reference to the following drawings, description and claims.

DETAILED DESCRIPTION OF THE INVENTION

Figure 1:
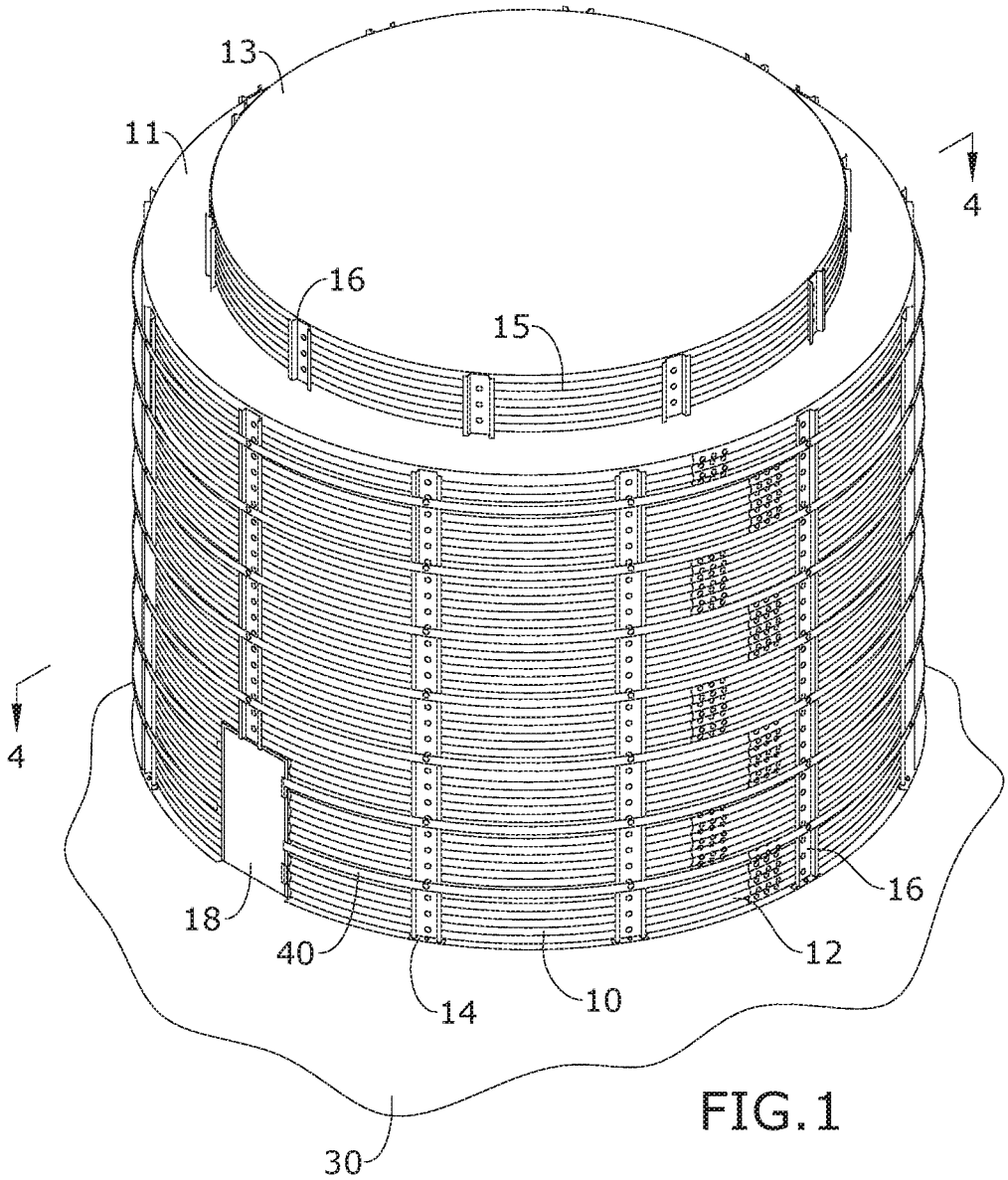
FIG. 1 is a perspective view of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a radiation shielding vault structure that saves time, money, and is reusable. The present invention uses a combination of wall materials to replace the need for reinforcement rods when concrete shielding material is used. The present invention is built by attaching wall panels together, allowing for all build material needed to fit inside of one shipping container, saving material transportation costs. The present invention is faster to construct and is half the cost of traditional vaults. The present invention is 100% reusable. The present invention is also made of cylinder shaped inner and outer walls with radiation shielding filler therebetween. Because the present invention uses inner and outer walls, spacing between the inner and outer walls can be adjusted to accommodate any level of shielding needed.

The present invention includes inner ring wall panels and outer ring wall panels attached using the wall fasteners. The outer ring wall panels are supported using upright wall braces that are mounted to the foundation using reinforced wall brace mounts. The outer ring wall system is also supported with multiple continuous support band straps mounted to the outer ring wall system. Upper tie rods are mounted between the inner ring wall system and outer ring wall system to support and hold the spacing between the wall systems. In between the inner ring wall system and the outer ring wall system is filled with shielding material, such as sand or concrete or other types of materials. A tunnel structure is placed in between the inner ring wall system and outer ring wall system to access the inside shielded area. A shielded door is mounted to the tunnel system. Pylons are placed in between the inner ring wall system and outer ring wall system to support the ceiling I-beams. A keyed roof or a steal panel roof is attached to the top of the I-beams. Close out panels are attached to each end of the I-beams to keep shielding materials from getting into the inner shielded area. Formed concrete or dense block can be placed on the inside area of the shielded room or when sand is used it can be placed between the inner ring wall system and the outer ring wall system if more primary shielding is required. An added smaller outer ring wall system can be placed on the roof and built up higher to allow for more shielding material for extra primary shielding when needed. Lead or dense block can also be placed on the ceiling keyed sub-floor in sand shielding applications to allow for low clearance limitations. Optional dense block or formed concrete can be placed inside the shielded area to act as a hallway to breakdown the radiation and allow for a much thinner shielded door if required.

Figure 2:
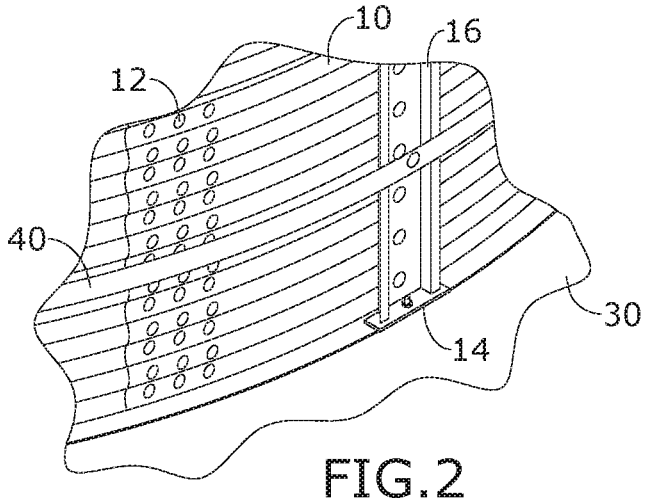
FIG. 2 is a detail section view of an embodiment of the present invention.
Figure 3:
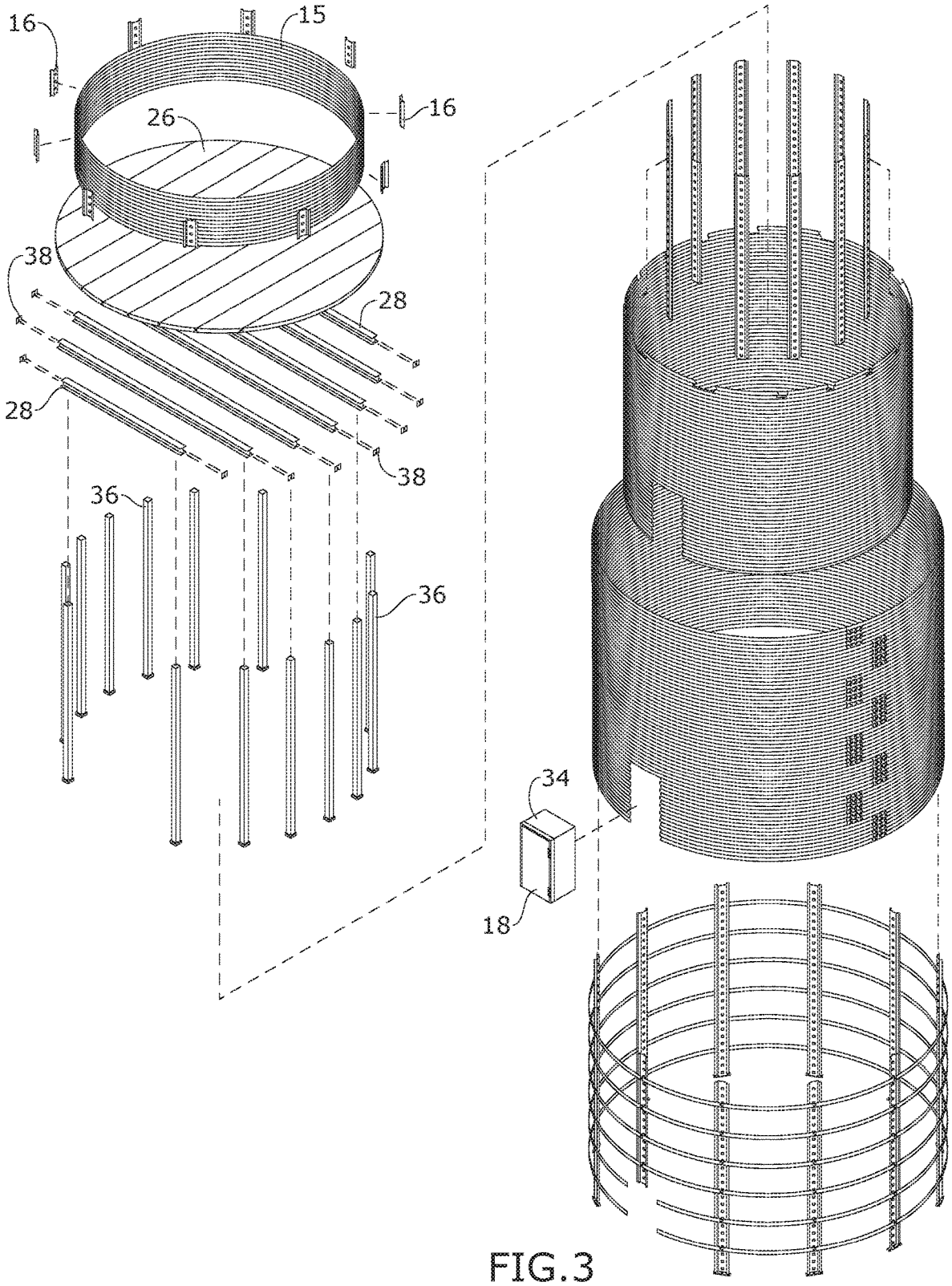
FIG. 3 is an exploded view of an embodiment of the present invention.
Figure 4:
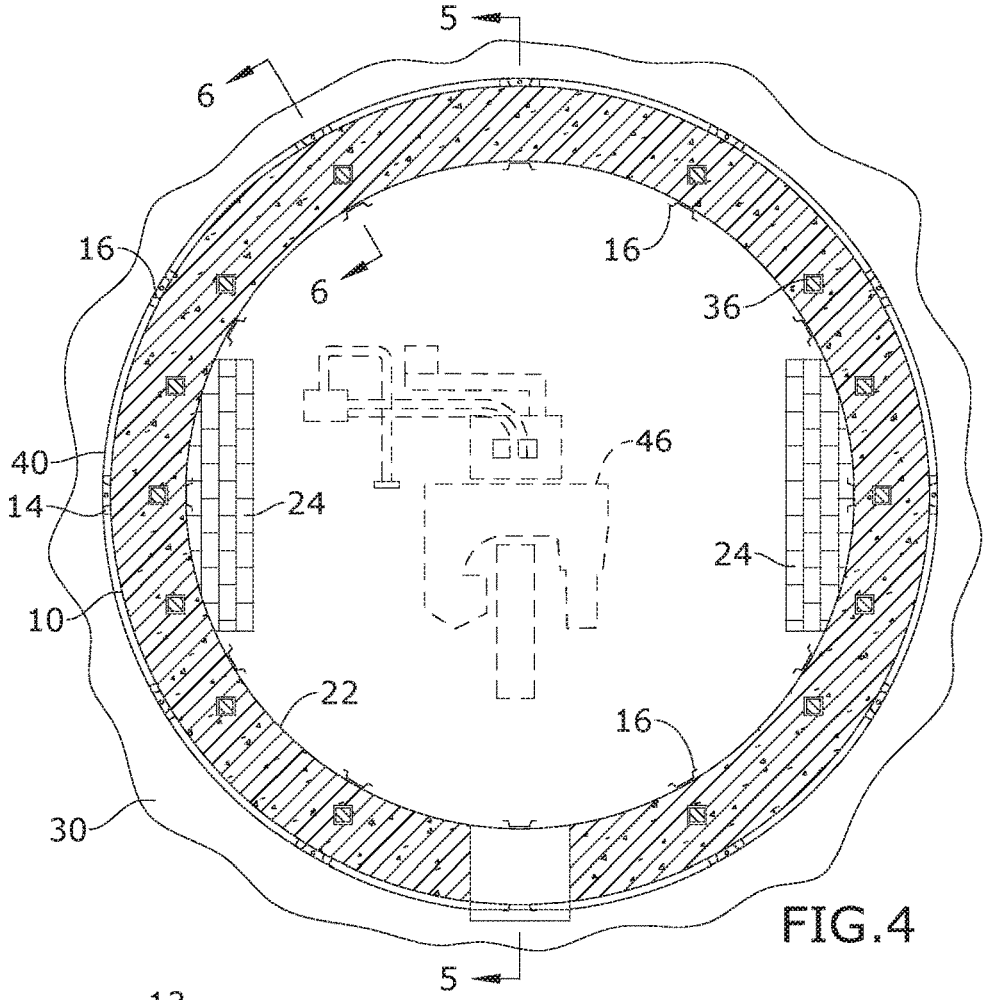
FIG. 4 is a section view of the present invention taken along line 4-4 of FIG. 1.
Figure 5:
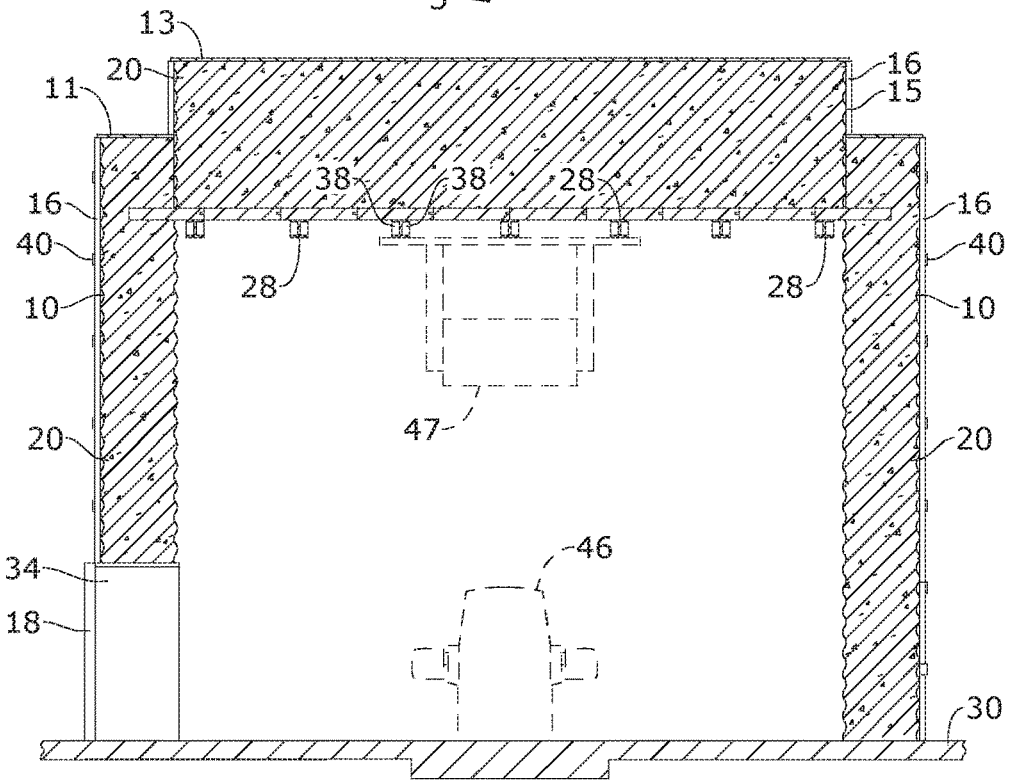
FIG. 5 is a section view of the present invention taken along line 5-5 in FIG. 4.
Figure 6:
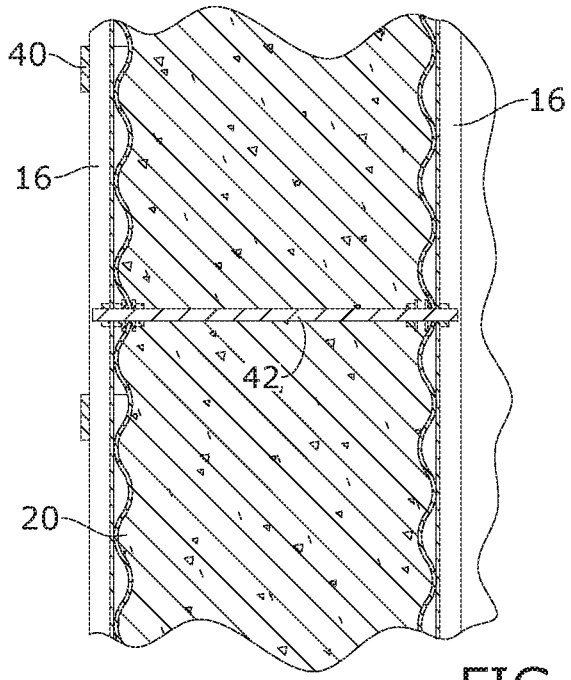
FIG. 6 is a detail section view of the present invention taken along line 6-6 in FIG. 4.
Figure 7:
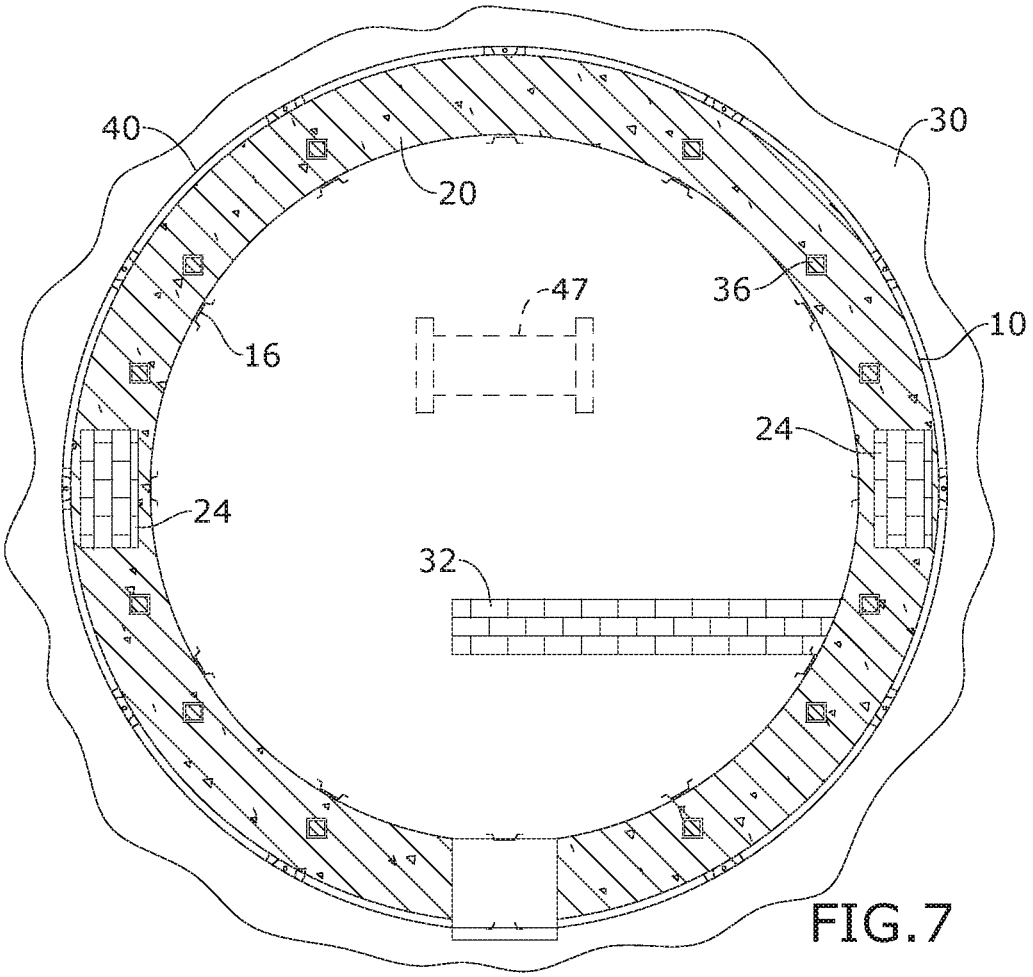
FIG. 7 is a section view of an embodiment of the present invention.

Referring to FIGS. 1 through 7, the present invention includes a radiation shielding vault or structure. The radiation shielding vault includes an outer wall 10 and an inner wall 22. The outer wall 10 includes at least one outer wall panel formed into a cylinder shape having an outer wall opening. The inner wall 40 includes at least one inner wall panel formed into a cylinder shape having an inner wall opening aligned with the outer wall opening. Tie rods 42 secure the inner wall 22 to the outer wall 10 to support and hold the spacing between the walls 22, 10. A tunnel structure 34 is inside the inner wall opening and the outer wall opening. A radiation shielding door 18 is coupled to the tunnel structure 34. A radiation shielding filler material 20 is disposed in between the outer wall 10 and the inner wall 22. A roof 11 covers open top ends of the inner wall 22 and the outer wall 10.

In certain embodiments, the outer wall 10 and the inner wall 22 are made of a plurality of corrugated metal panels coupled together by fasteners 12. The outer wall 10 and the inner wall 22 may rest on a foundation 30. A plurality of vertical wall braces 16 and a plurality of horizontal support bands 40 add structural support to the outer wall 10 and the inner wall 22. The plurality of vertical wall braces 16 are fastened to the foundation 30 by floor mounts 14.

The present invention further includes a ceiling 26. In certain embodiments, a radiation filler material 20 is disposed in between the ceiling 26 and the roof 11, adding additional radiation protection. The ceiling 26 is made of a metal plate or may include interlocking panels.

In certain embodiments, the present invention includes a plurality of pylons 36 disposed within the radiation shielding material 20 and supporting the ceiling 26. In certain embodiments, a plurality of I-beams 28 rest on top ends of the plurality of pylons 36 beneath the ceiling 26. Close out panels 38 are attached to each end of the I-beams 28 to keep shielding filler material 20 from getting into the inner shielded area.

In certain embodiments, the present invention includes additional shielding for the roof when additional primary shielding is required for a medical x-ray machine 47 or another machine. In such embodiments, the present invention includes an upper wall 15. The upper wall 15 includes at least one upper wall panel formed into a cylinder shape. For example, the upper wall 15 is made of a plurality of corrugated metal panels coupled together by fasteners 12. The upper wall 15 is coupled to an upper surface of the roof 11. Radiation shielding filler 20 is disposed within the upper wall 15 and the upper wall 15 is capped with an upper roof 13.

Since the present invention uses inner and outer walls 22, 10, spacing between the inner and outer walls 22, 10 may be adjusted based on a level of shielding needed for different types of radiation equipment 46. Additionally, shielding blocks 24 may be disposed in between the inner wall 22 and outer wall 10 or inside the structure for additional radiation protection. For example, a block wall 32 may be constructed inside the structure to add additional shielding when required. The shielding blocks 24 may include formed concrete, dense block or lead if more primary shielding is required.

A method of making the present invention may include the following steps:

1. Site prep, inspect foundation the system is built on.
2. Lay down the floor angle brackets with sealant to the floor for the inner wall ring.
3. Set and start installing the first row of the inner wall ring panel system using bolts and sealant to each mating piece.
4. Once the first row is finished, start installing the second row of panels attaching each panel to the lower row of panels.
5. Continue adding rows of panels until you're at the desired height for the inner shielded room.
6. On the inside of the inner wall ring, install the floor mount brackets for all the wall upright support braces.
7. Install all the inner wall ring support braces to the floor brackets and to all the inner panels all the way up to the top ceiling area.
8. Outside of the inner wall rings, install all the pylons around the periphery wherever support is needed for the I-beams—pylons to be secured to the floor. (I-beams and pylons not required if a ceiling is not needed in certain circumstances)
9. Notch out (cut-out) the inner wall ring top panels so the I-beams recess down into them to a flush position. These notches (cut-outs) can be put in ahead of time before installation as well.
10. Set each I-beam down into the notches (cut-outs) of the inner wall panels and down onto the pylons. Secure I-beams to the pylons.
11. When sand is used, add dense block or equivalent in between the inner and outer wall ring panel for added primary shielding if needed.
12. When concrete is used, add dense block or equivalent on the sides of the inside shielded room area if added primary shielding is needed.
13. Install the close out panels using screws and sealant to the end openings of each I-beam where it mates to the notches out openings. This seals off the inner room from the ends of the I-beams.
14. Install the interlocking panels on the top of all the I-beams to close off the top area of the inner room.
15. HVAC can then be added if required.
16. If added primary shielding is needed in the ceiling area, a smaller outer wall ring can be built up to the height required and placed onto the inter-locking ceiling panels.
17. Lay down the floor angle brackets with sealant to the floor for the outer wall ring.
18. Set and start installing the first row of the outer wall ring panel system using bolts and sealant to each mating piece.
19. Once the first row is finished, start installing the second row of panels attaching each panel to the lower row of panels.
20. Continue adding rows of panels until you're at the desired height for the outer wall ring—this will be higher than the I-beams and set based on the shielding depth required.
21. On the outside of the outer wall ring, install the floor mount brackets for all the wall upright support braces.
22. Install all the outer wall ring support braces to the floor brackets and to all the outer panels all the way up to the top ceiling area.
23. Cut-out the opening needed for the tunnel system in both the inner and outer wall rings. These cut-outs can also be put in ahead of time
24. Install and seal then tunnel system to all the wall ring opening edges and to the floor.
25. Install all the upper tie-rods that go between the inner and outer wall rings top edge area.
26. Install the support bands when required all around the outer wall ring every 4 feet—secure to tunnel area on bands in that area.
27. Install wire-ways needed between the inner and outer wall ring panels to bring in power and communication wires into the room.
28. Using a pumper style conveyor or equivalent, start loading the shielding material (sand, concrete . . . ) into the area between the inner and outer wall rings. Pack down as needed. All shielding materials should be tested and approved before installation.
29. Fill the walls and entire ceiling with the shielding material as required.
30. Mount and install the door with hardware.
31. Painting is done to any bare metal.
32. Squared off finished walls can be added to the inside and the outside to hide the round shielded walls It should be understood, of course, that the foregoing relates to exemplary embodiments of the invention and that modifications may be made without departing from the spirit and scope of the invention as set forth in the following claims.

What is claimed is:

1. A radiation shielding vault comprising:

an outer wall comprising at least one outer wall panel formed into a cylinder shape and comprising an outer wall opening;

an inner wall comprising at least one inner wall panel formed into a cylinder shape and comprising an inner wall opening aligned with the outer wall opening;

a tunnel structure is inside the inner wall opening and the outer wall opening;

a radiation shielding door coupled to the tunnel structure;

a radiation shielding filler material disposed in between the outer wall and the inner wall;

a roof covering open top ends of the inner wall and the outer wall;

a ceiling, wherein the radiation shielding material is disposed in between the ceiling and the roof; and a plurality of pylons disposed within the radiation shielding material and supporting the ceiling.

2. The radiation shielding vault of claim 1, wherein each of the at least one outer wall panel and the at least one inner wall panel are a plurality of metal panels coupled together.

3. The radiation shielding vault of claim 2, wherein the plurality of metal panels are corrugated.

4. The radiation shielding vault of claim 2, further comprising a foundation, wherein the outer wall and the inner wall are disposed on the foundation.

5. The radiation shielding vault of claim 4, further comprising a plurality of vertical wall braces and a plurality of horizontal support bands coupling the plurality of metal panels together, wherein the plurality of vertical wall braces are fastened to the foundation.

6. The radiation shielding vault of claim 1, further comprising a plurality of I-beams resting on top ends of the plurality of pylons and underneath the ceiling.

7. The radiation shielding vault of claim 1, further comprising an upper wall comprising at least one upper wall panel formed into a cylinder shape, the upper wall coupled to an upper surface of the roof, wherein the radiation shielding filler is disposed within the upper wall.

8. The radiation shielding vault of claim 1, further comprising shielding blocks disposed in at least one of an inside of the inner wall and in between the inner wall and the outer wall.

* * * * *